US005501135A

United States Patent [19]

Beretta

[11] Patent Number: 5,501,135

[45] Date of Patent: Mar. 26, 1996

[54] PRECISION MECHANISM FOR HANDGUNS

[75] Inventor: Ugo G. Beretta, Brescia, Italy

[73] Assignee: Fabrica D'Armi P. Beretta S.p.A., Brescia, Italy

[21] Appl. No.: 422,144

[22] Filed: Apr. 11, 1995

[30] Foreign Application Priority Data

Jun. 23, 1994 [IT] Italy ..... BS94A0075

[51] Int. Cl.[6] ..... F41A 21/48

[52] U.S. Cl. ..... 89/196; 89/163; 42/75.02

[58] Field of Search ..... 42/75.02, 75.01, 42/76.01, 71.02; 89/196, 163, 14.05

[56] References Cited

U.S. PATENT DOCUMENTS 2,898,693 8/1959 Ruger ..... 89/196

4,896,581 1/1990 Cole ..... 89/196

*Primary Examiner*—Stephen M. Johnson

*Attorney, Agent, or Firm*—McGlew and Tuttle

[57] ABSTRACT

The present invention pertains to a precision mechanism for guns, in which the barrel of the gun has a threaded end section and a cylindrical section on the outside, and in which an alignment bushing, which has an outer conical surface with a conicity corresponding to the conicity of the conical hole in the breech-block carriage, is mounted on the cylindrical section, and an adjustment ring intended for resting against the alignment bushing and the breechblock carriage and a threaded locking ring of the said striking ring are screwed onto the said threaded section.

5 Claims, 1 Drawing Sheet

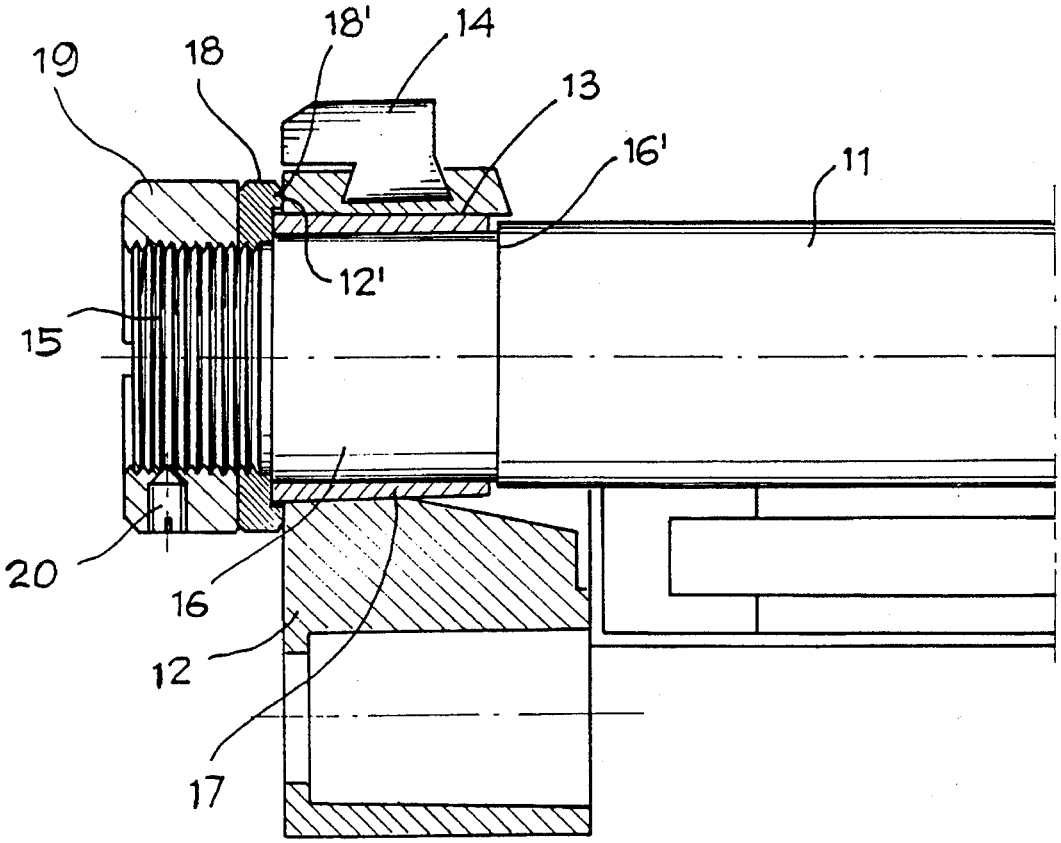
19
18
18'
14
13
16'
11
12'
15
20
16
12
17

PRECISION MECHANISM FOR HANDGUNS

FIELD OF THE INVENTION

The present invention pertains to an improvement in the precision of handguns, and it especially pertains to semiautomatic guns of various calibers of the type having a barrel-breechblock carriage assembly with recoil, in which the barrel is capable of axial movements with regard to the breechblock carriage.

BACKGROUND OF THE INVENTION

In these guns, the initial cartridge is usually loaded into the firing chamber, manually moving back the breechblock carriage against the action of a counter recoil spring or another spring-type means of the magazine. The breechblock carriage, when released, then moves forward to collect the cartridge and to lock the barrel-breeehblock carriage assembly in the closed position. Each subsequent cartridge is similarly collected by the action of the compressed gases which are generated by the fired cartridge, an action which brings about the retrograde movement of the breechblock carriage, the brief recoil of the barrel with respect to the stroke of the breechblock carriage, and the extraction of the case of the fired cartridge.

A sight, used by the operator to better aim at the selected target, is usually mounted on the front part of the breechblock carriage. However, the barrel is a separate component and is guided with a certain clearance on the breechblock carriage; therefore, any poor alignment between the barrel and the breechblock carriage, when they are in the firing position, leads to a lack of precision of the gun, in that the barrel may deviate upwards or downwards, to the right or to the left, in an uncontrolled manner.

Various forms of precision mechanisms for guns, one of which is described in U.S. Pat. No. 4,896,581, have already been proposed to find a solution for such a drawback. This known mechanism consists of a bushing, which is screwed onto the front end of the barrel and has an outer conical surface intended for being joined together with a conical hole made in the front part of the breechblock carriage.

However, in this embodiment, centering and alignment lock between the barrel and the breechblock carriage are exclusively assigned to the conical surfaces outside the bushing and inside the hole in the breechblock carriage, as soon as there is no positive lock or striking of the barrel against the head surface of the breechblock carriage. Furthermore, the conical bushing, continuously stressed with the use of the gun, is subject to surface wear and also has the tendency to become unscrewed, conditions which, over time, involve changes in the action and in the precision of the bushing and consequently a loss of accuracy.

SUMMARY AND OBJECTS OF THE INVENTION

The object of the present invention is to find an effective solution for the above-mentioned drawbacks with a precision mechanism for guns, which mechanism has a novel, original design and the advantages of always ensuring the alignment between the barrel and the breech-block carriage, of also achieving a positive "front" lock between the barrel and the breechblock carriage in addition to a conical coupling in the axial direction, and of compensating the axial clearances due to processing tolerances and to the wear of the conical parts thanks to a lock component which has at least one certain degree of adjustment and which can be identified in the part intended for defining the front lock between the barrel and the breechblock carriage.

According to the invention, a precision mechanism for semiautomatic handguns is provided. The semiautomatic handgun being of a type with a barrel-breechblock carriage assembly with recall. The barrel is capable of axial movement with regard to the breechblock carriage and the breechblock carriage has a conical hole into which the barrel extends. The conical hole decreases in diameter from the front to the rear of the breechblock carriage. The precision mechanism includes a barrel front part with an outside having a threaded end section and a cylindrical section following said threaded end section in a rearward direction. An alignment bushing, which has an outer conical surface with a conicity corresponding to a conicity of said conical hole and is intended for being joined together axially with the conical hole, as mounted on the cylindrical section. An adjustment ring, intended for resting against the alignment bushing and the breechblock carriage and a threaded locking ring of a striking ring, are screwed onto the threaded section.

The adjustment ring preferably has an annular front projection which rests against the front face of the breechblock carriage when the conical alignment bushing is connected to the conical hole. The conical alignment bushing is held axially between the adjustment ring and an annular shoulder at the end of the cylindrical section at a distance from the threaded section. The threaded ring is preferably locked on the threaded section of the barrel by means of a radial screw.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The sole FIGURE shows a partial sectional view of the precision mechanism applied to a barrel-breeehblock carriage assembly of a gun.

DETAILED DESCRIPTION 0F THE PREFERRED EMBODIMENT

As shown in the drawing, the hole 13 in the breechblock carriage 12 is conical and narrows from the front to the rear. On the outside, in its front part, the barrel 11 has a threaded end section 15 and a cylindrical section 16 following this, towards the rear of the barrel. The cylindrical section 16 has a diameter that is at least slightly greater than the threaded end section 15, but less than the remaining part of the barrel, for which an annular striking step 16' is arranged between the cylindrical section 16 and the remaining part of the barrel.

An alignment bushing 17, which has an outer conical surface with a conicity similar to that of the conical hole 13 and is intended for being joined together with same, is mounted on the said cylindrical section 16 of the barrel.

The conical bushing 17 will be able to rest against the striking step 16'.

An adjustment ring 18 and a threaded locking ring 19 are screwed onto the threaded section 15 of the barrel 11. The ring 18 is screwed on until it rests against the adjoining end of the conical bushing 17. However, it has a front annular projection 18' intended for striking against the front face 12' of the breechblock carriage 12.

The locking ring 19 rests against the adjustment ring 18, locking it, and in its turn, it is locked on the threaded section 15 by means of a radial screw 20.

The assembly described permits relative axial displacements between the barrel 11 and the breechblock carriage 12 during the operation of the gun by the collection of the cartridge and the extraction of the fired case. Moreover, the conical bushing-conical hole coupling of the two interacting components (barrel and breechblock carriage) makes it possible to ensure the correct alignment of the barrel when the gun is closed for firing. For its part, the adjustment ring 18 forms a positive lock between the front face of the breechblock carriage and makes it possible to restore the coupling tolerances and the wear clearances for a reliable, lasting precision operation.

While a specific embodiment of the invention has been shown and described in detail to illustrate the application of the principles of the invention, it will be understood that the invention may be embodied otherwise without departing from such principles.

What is claimed is:

1. A semiautomatic handgun with precision mechanism comprising: a barrel-breechblock carriage assembly, the barrel being capable of axial movement with regard to the breechblock carriage, the breechblock carriage having a conical hole, said barrel extending into said conical hole, said conical hole decreasing in diameter from a front to a rear of the breechblock carriage; a threaded end section provided on an outside front part of said barrel; a cylindrical section following said threaded end section towards a rear of the handgun; an alignment bushing having an outer conical surface with a conicity substantially corresponding to a conicity of said conical hole, said cylindrical section being intended for joining together axially with said conical hole, said alignment bushing being mounted on said cylindrical section; an adjustment ring intended for resting against said alignment bushing and said breechblock carriage; and a threaded locking ring screwed onto said threaded section.

2. Precision mechanism according to claim 1, wherein said adjustment ring has an annular front projection which rests against a front face of said breechblock carriage when said conical alignment bushing is connected to said conical hole.

3. Precision mechanism according to claim 1, wherein said conical alignment bushing is held axially between said adjustment ring and an annular shoulder at an end of said cylindrical section at a distance from said threaded section.

4. Precision mechanism according to claim 2, wherein said conical alignment bushing is held axially between said adjustment ring and an annular shoulder at an end of said cylindrical section at a distance from said threaded section.

5. A precision mechanism according to claim 1, further comprising a radial screw, said threaded ring being locked on said threaded section of said barrel by means of said radial screw.

* * * * *